US010994398B1

(12) United States Patent
Eghbal

(10) Patent No.: US 10,994,398 B1
(45) Date of Patent: May 4, 2021

(54) ADJUSTABLE GRIP DUAL-MATING HOUSING STRUCTURE FOR REMOVAL OF A FAUCET HANDLE TO GAIN ACCESS TO A CORRODED VALVE STEM

(71) Applicant: Michael Eghbal, Beverly Hills, CA (US)

(72) Inventor: Michael Eghbal, Beverly Hills, CA (US)

( * ) Notice: Subject to any disclaimer, the term of this patent is extended or adjusted under 35 U.S.C. 154(b) by 401 days.

(21) Appl. No.: 16/016,628

(22) Filed: Jun. 24, 2018

(51) Int. Cl.
*B25B 27/24* (2006.01)
*B25B 27/02* (2006.01)

(52) U.S. Cl.
CPC ..... *B25B 27/24* (2013.01); *B25B 27/023* (2013.01)

(58) Field of Classification Search
CPC ..... B25B 27/02; B25B 27/023; B25B 27/14; B25B 27/24; B25B 5/00; B25B 5/067; B25B 5/082; B66F 3/18; B66F 2700/04; Y10T 29/53552; Y10T 29/53843; Y10T 29/53861; Y10T 29/53909; Y10T 29/83848; Y10T 29/53852; Y10T 29/53857; Y10T 29/53865; Y10T 29/53878; E03C 1/04; E03C 1/041; E03C 2001/028
USPC ..... 29/213.1, 239, 249, 143
See application file for complete search history.

(56) References Cited

U.S. PATENT DOCUMENTS

| | | | | |
|---|---|---|---|---|
| 2,303,500 | A | 12/1942 | Knight | |
| 2,870,530 | A | 6/1959 | Dvorak | |
| 3,334,405 | A | 8/1967 | Cann et al. | |
| 3,872,569 | A | 3/1975 | Lane | |
| 4,123,838 | A * | 11/1978 | Magavero | B25B 27/023 29/261 |
| 4,624,449 | A * | 11/1986 | Gentry | B25B 27/023 254/231 |
| 4,691,424 | A * | 9/1987 | Schmidt | B25B 27/023 29/261 |
| 4,823,453 | A * | 4/1989 | Bartlett | B25B 27/023 29/261 |
| 5,119,556 | A | 6/1992 | Hseu | |
| 5,233,740 | A | 8/1993 | Chen | |
| 5,257,445 | A | 11/1993 | Mayberry | |
| 5,915,741 | A | 6/1999 | Parker | |
| 7,216,409 | B1 | 5/2007 | Chiu et al. | |
| 8,079,123 | B2 | 12/2011 | Lin | |
| 2010/0115748 | A1 | 5/2010 | Lin | |

* cited by examiner

*Primary Examiner* — Orlando E Aviles
*Assistant Examiner* — Robert F Neibaur

(57) ABSTRACT

An apparatus for removing a faucet handle that utilizes dual housing mating members for support that prevents the sink from having a direct force placed upon the sink while the apparatus is in use. The apparatus further provides a mating two housing structure having adjustable slots and corresponding wing nuts that will allow a bottom plate to open and close to allow variety of different sized faucet handles to be retained inside of two plates to retain the faucet handle during removal.

5 Claims, 11 Drawing Sheets

ADJUSTABLE GRIP DUAL-MATING HOUSING STRUCTURE FOR REMOVAL OF A FAUCET HANDLE TO GAIN ACCESS TO A CORRODED VALVE STEM

BACKGROUND OF THE INVENTION

1. Field of the Invention

The present invention relates to the field of replacing a worn out and corroded valve steam of a faucet wherein access to the valve stem is blocked by a portion of the faucet handle.

2. Description of the Prior Art

The following eleven patents and published patent applications are the closest prior art known to the inventor.

1. U.S. Pat. No. 2,303,560 issued to Henry J. Knight on Dec. 1, 1942 for "Gear Puller";
2. U.S. Design Pat. No. 2,870,530 issued to Ervin J, Dvorak on Jun. 27, 1959 for "Faucet Handle Puller";
3. U.S. Pat. No. 3,334,405 issued to Arthur S. Cann et al. on Aug. 8, 1967 for "Faucet Handle Remover";
4. U.S. Pat. No. 3,872,569 issued to Lee Lane on Mar. 25, 1975 for "Faucet Handle Remover Tool";
5. U.S. Pat. No. 5,119,556 issued to Wanlie Hseu on Jun. 9, 1992 for "Tool for Removal of Faucet Stem and Cartridge";
6. U.S. Pat. No. 5,233,740 to Jui-Nien Chen on Aug. 10, 1993 for "Hydraulic Puller";
7. U.S. Pat. No. 5,257,445 issued to George Mayberry on Nov. 2, 1993 for "Bearing and Pillow Block Puller";
8. U.S. Pat. No. 5,915,741 issued to Robert Parker on Sep. 29, 1997 for "Faucet Cartridge Puller Assembly and Method of Use";
9. U.S. Pat. No. 7,216,409 issued to Ching-su Chiu et al. on May 15, 2007 for "Gear Puller";
10. United States Published Patent Application No. US 2010/0115748 to Liang-Hui Lin on May 13, 2010 for "Puller That is Assembled and Disassembled Easily and Quickly"; and
11. U.S. Pat. No. 8,079,123 issued to Liang-Hui Lin on Dec. 20, 2011 for "Puller That is Assembled and Disassembled Easily and Quickly".

Especially relevant is U.S. Pat. No. 3,334,405 issued to Arthur S. Cann et al. on Aug. 8, 1967 for "Faucet Handle Remover" (hereafter the "Cann Patent"). This patent illustrates the problem of removing the corroded valve stem from a sink faucet from sinks which have a faucet handle with a central opening to enable the handle to be removed more efficiently as illustrated in the Cann Patent. What is best known in the prior art is illustrated in the Cann Patent. To the best of the inventor's knowledge, all prior inventions and available products in the market rely on having a hole in the central axis of the faucet handle which exposes the top part of the valve stem so that the pushing shaft of the pulling device rests on the top exposed part of the valve stem through the faucet handle axial hole, while the grabbing part of the device pulls the faucet handle away from the stem. This is illustrated in particular in FIG. 1 and FIG. 2 of the Cann Patent. In order to utilize current known procedures for removing a faucet handle from a corroded valve stem, the faucet handle must have an axial opening or central opening so that an instrument can gain access to the valve stem. The present invention addresses the faucet handle where there is no such axial opening in the faucet handle, yet the faucet handle is still corroded into the valve stem in the sink.

SUMMARY OF THE INVENTION

The present invention relates to an apparatus for removing a faucet handle to gain access to a valve stem from a faucet in which the valve stem has become corroded and is difficult to remove and replace.

A major problem that is addressed by the present invention is that there are numerous faucets which do not enable a faucet handle to be removed to gain access to a faucet valve stem if the valve stem is corroded and needs to be removed from the faucet.

The invention incorporates an additional resting piece (central housing member) in order to provide a platform for a pushing shaft, while the pulling part (screw housing member) pulls the faucet handle away from the valve stem. Therefore, it can be used on faucets with or without an axial hole in the faucet handle.

Therefore, for any structure where the sink has a faucet that does not have the axial hole as described above, there are no known ways to remove the handle except by breaking the handle and causing significant damage to the faucet and to the sink assembly.

The present invention addresses this problem by enabling access to the faucet stem which has become corroded due to its connection in the faucet and to the faucet handle. In some embodiments, the faucet handle has a gripping section and a central barrel section. The central barrel section includes a collar above a top surface of the faucet base. A small faucet gap separates the collar of the central barrel section and the top surface of the faucet base. It is also within the spirit and scope of the present invention for a lower central portion of the handle to be spaced apart from the top surface of the faucet base with no central barrel and no collar. The present invention enables access to the valve stem which is to be removed even if there is no axial hole in the center of the handle.

It is an object of the present invention to provide a simple mechanical apparatus for removing a faucet handle from a corroded valve stem in a faucet base by applying a force to remove the faucet handle from a corroded valve stem.

It is also an object of the present invention to provide adjustable slots and corresponding wing nuts that will allow at least one bottom plate to open and close to allow a faucet handle to be retained above two plates the faucet handle removal process.

It is an additional object of the present invention to provide a central housing support structure that has two vertical legs that extend to opposite respective horizontal surfaces for transferring the force applied to the faucet handle while it is being removed to a larger surface area of the sink and therefore, reduce the chance of damaging the sink.

It is a further object of the present invention to have both housing structures made of high strength low deflection material such as steel, or other high strength metal alloy.

It is still a further object of the present invention to provide the screw housing in a general "C" shape and to provide the central housing in a general inverted "U" shape as part of the faucet handle removal apparatus.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
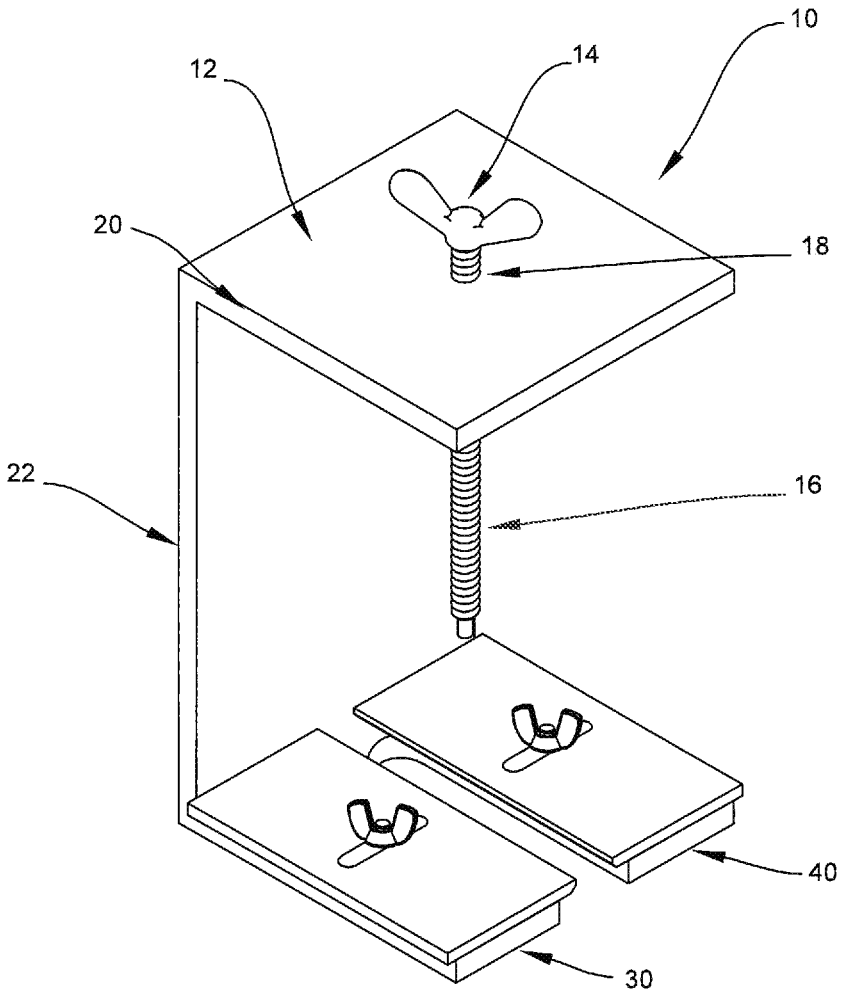
FIG. 1 is a perspective view of the screw housing member of the present invention adjustable grip dual-mating housing structure for removal of faucet handles, illustrating the two wing nuts and one wing head screw and respective hole locations on the screw housing.

Referring to FIG. 1, there is illustrated a front perspective view of the screw housing member 10 of the present invention faucet handle remover 100 (illustrated in FIG. 6) illustrating a top wing head 14 that is connected to a top threaded shaft 16 (wing head 14 and threaded shaft 16 may be one piece called a "wing head screw"). Top threaded shaft 16 is sized to fit through top threaded hole 18 located in the center of top surface 12 of screw housing top/horizontal wall 20. Screw housing member 10 has a generally C-shaped body having a central housing vertical wall 22 that connects central housing top/horizontal wall 20 with a left bottom base plate 30 and a right bottom base plate 40. Top threaded shaft 16 and top wing head 14 are more broadly defined as a "top fastening member".

Figure 2:
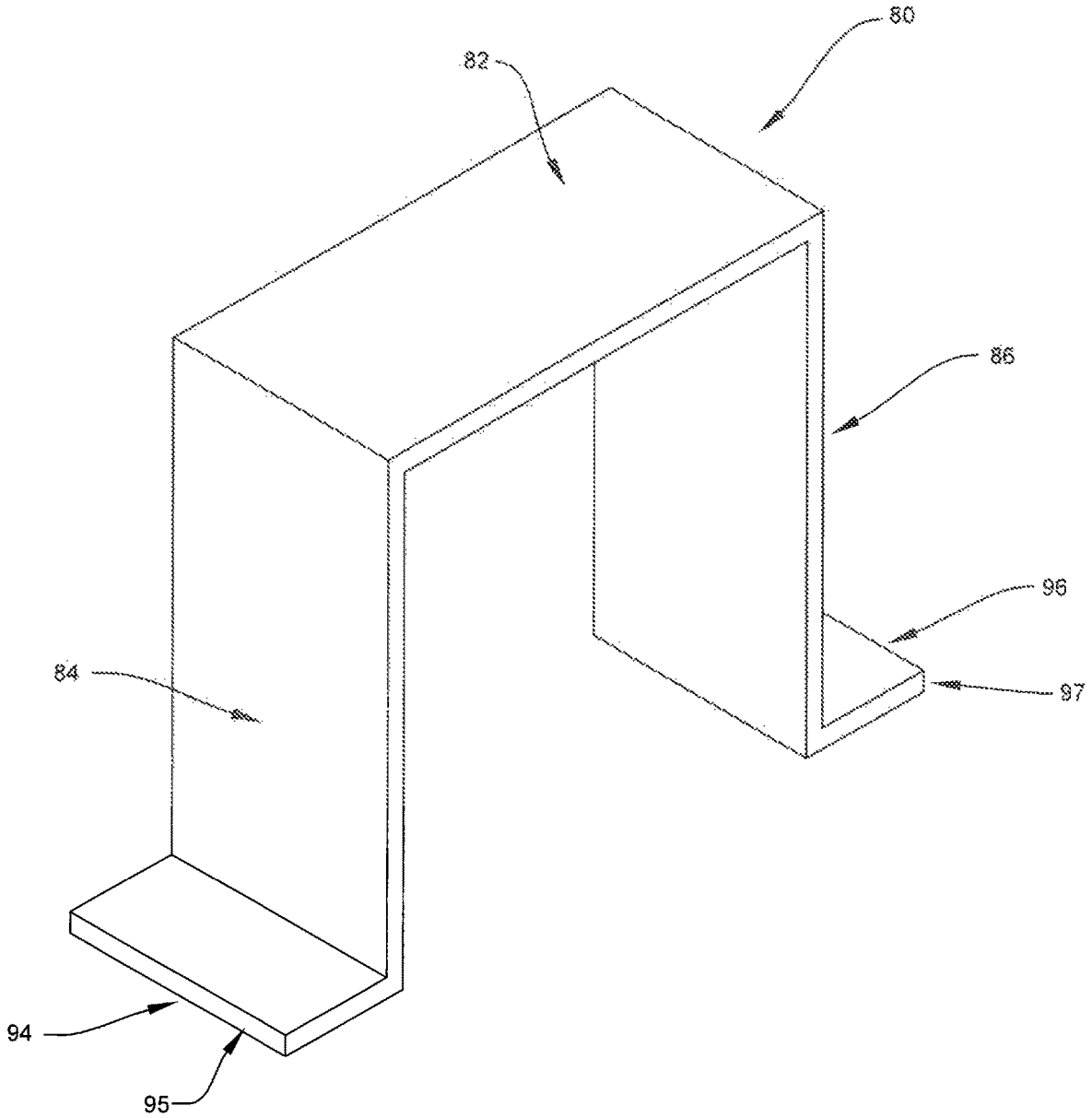
FIG. 2 is a perspective view of the central housing member of the present invention adjustable grip dual-mating housing structure for removal of faucet handles, illustrating the generally inverted U-shaped structure with vertical support walls and horizontal transfer plates.

Referring to FIG. 2, there is illustrated a perspective view of the central housing member 80 of the present invention faucet handle remover 100 (illustrated in FIG. 6) having a generally inverted U-shaped body with the following components: (i) a central housing horizontal wall 82; (ii) a first or left central housing vertical wall 84 that connects to a first or left horizontal transfer plate 94 having a left horizontal transfer plate edge 95; and (iii) a second or right central housing vertical wall 86 that connects to a second or right horizontal transfer plate 96 having a right horizontal transfer plate edge 97.

Figure 3:
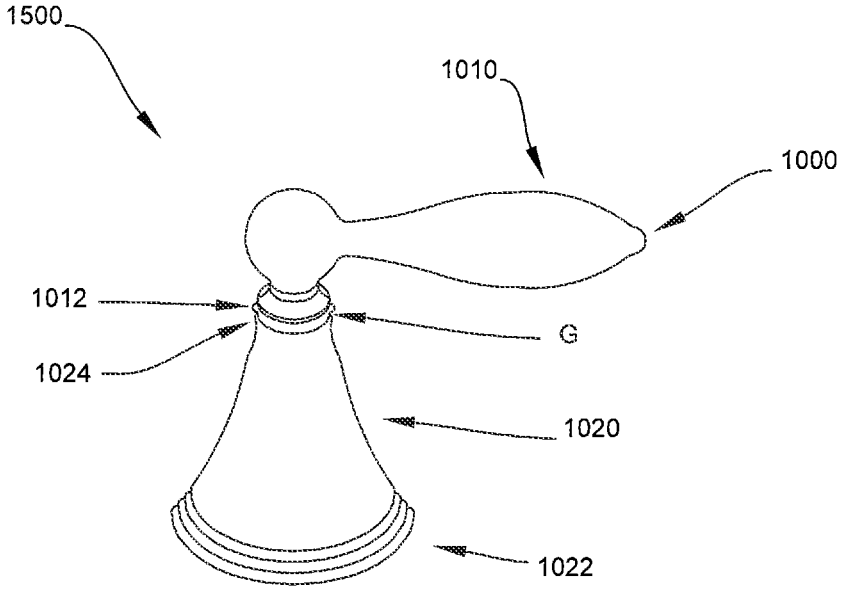
FIG. 3 is a perspective view of a faucet handle before it has been removed, with the faucet handle not having a central axial opening extending through the top of the faucet handle and with no access to the valve stem through any opening in the top of the faucet handle.
Figure 3A:
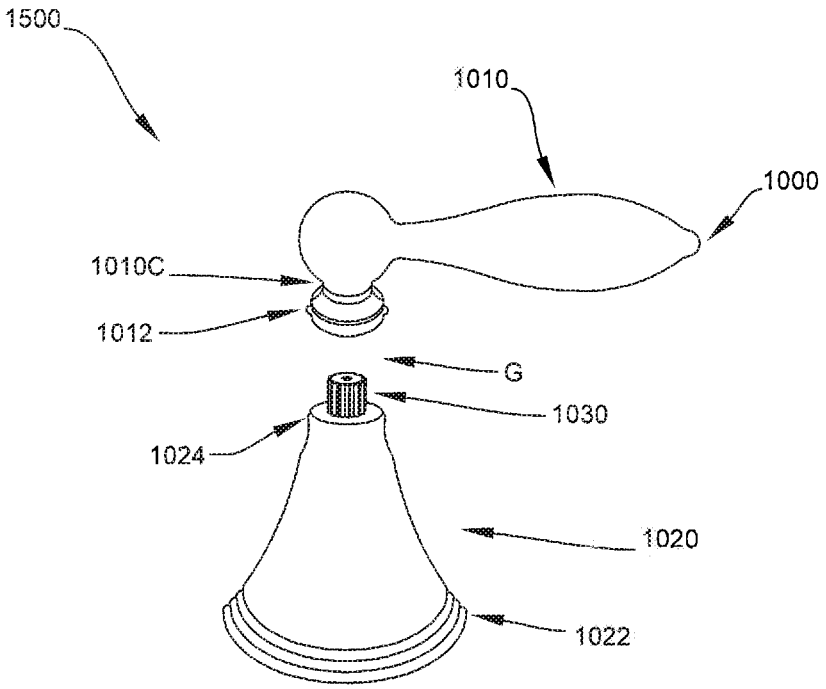
FIG. 3A is an exploded view of the components from FIG. 3 including a faucet handle after it has been removed, with the faucet handle not having a central axial opening extending through the top of the faucet handle which forms the basis for the requirement of the present invention to remove the faucet handle (regardless of whether or not it has become corroded) or otherwise affixed to the valve stem (corroded or not corroded) with no access to the valve stem through any opening in the top of the faucet handle, but a faucet gap between a collar affixed to the central barrel portion of the faucet handle and a top surface of the faucet base.
Figure 3B:
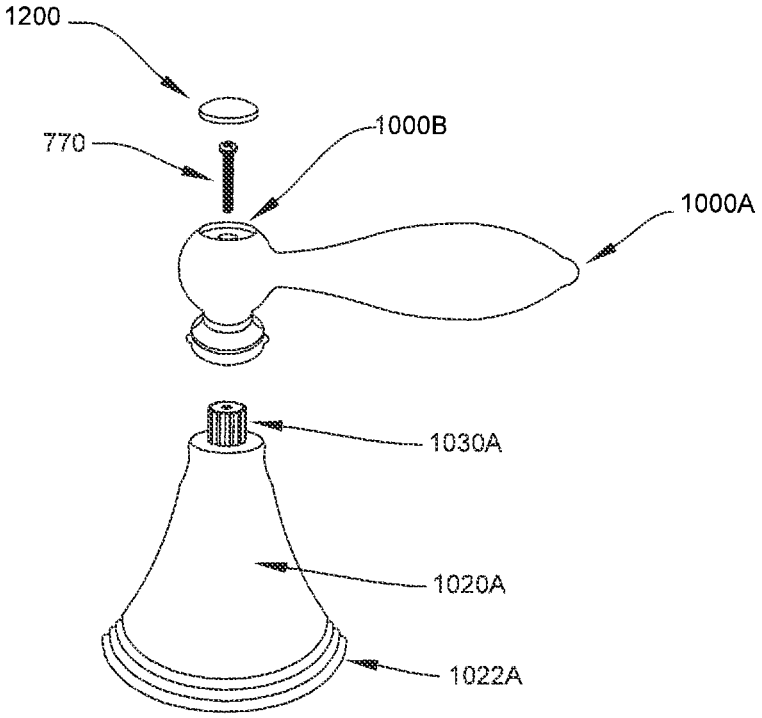
FIG 3B PRIOR ART
FIG. 3B is an exploded perspective view of a faucet handle of the prior art illustrating an opening in the top of the faucet handle to enable access to the valve stem.

Referring to FIGS. 3 and 3A, there is illustrated a faucet base 1020 having a bottom portion 1022 and a top surface 1024. Also illustrated is a faucet handle 1000 having a griping portion 1010 and a handle central barrel 1010C affixed to a collar 1012. There is a slight faucet gap G between top surface 1024 and the collar 1012 affixed to handle central barrel 1010C. This location is where a key innovation of the present invention operates since there is no valve stem that is visible when the faucet assembly 1500 is intact. The corroded valve stem 1030 is visible in the exploded view of FIG. 3A. Referring to FIG. 3B which is labeled "PRIOR ART", there is illustrated an exploded perspective view of a prior art faucet assembly which contains a faucet handle 1000A which has on its top an opening 1000B which is covered by cap 1200. When the cap is removed, the opening 1000B gives access to a screw 770 removed by a screwdriver (not shown). The thrust pin (as referred to in the Cann Patent) can then access the corroded valve stem 1030A and remove the corroded valve stem through opening 1000B. The prior art in FIG. 3B facilitates removal of the valve handle because the opening 1000B in the top of the valve handle 1000A facilitates access to the corroded valve stem 1030A. The present invention can be used with any of the prior art faucet assemblies but the main purpose of the present invention is to be able to remove the faucet handle 1000 when there is no central axial opening.

Figure 4:
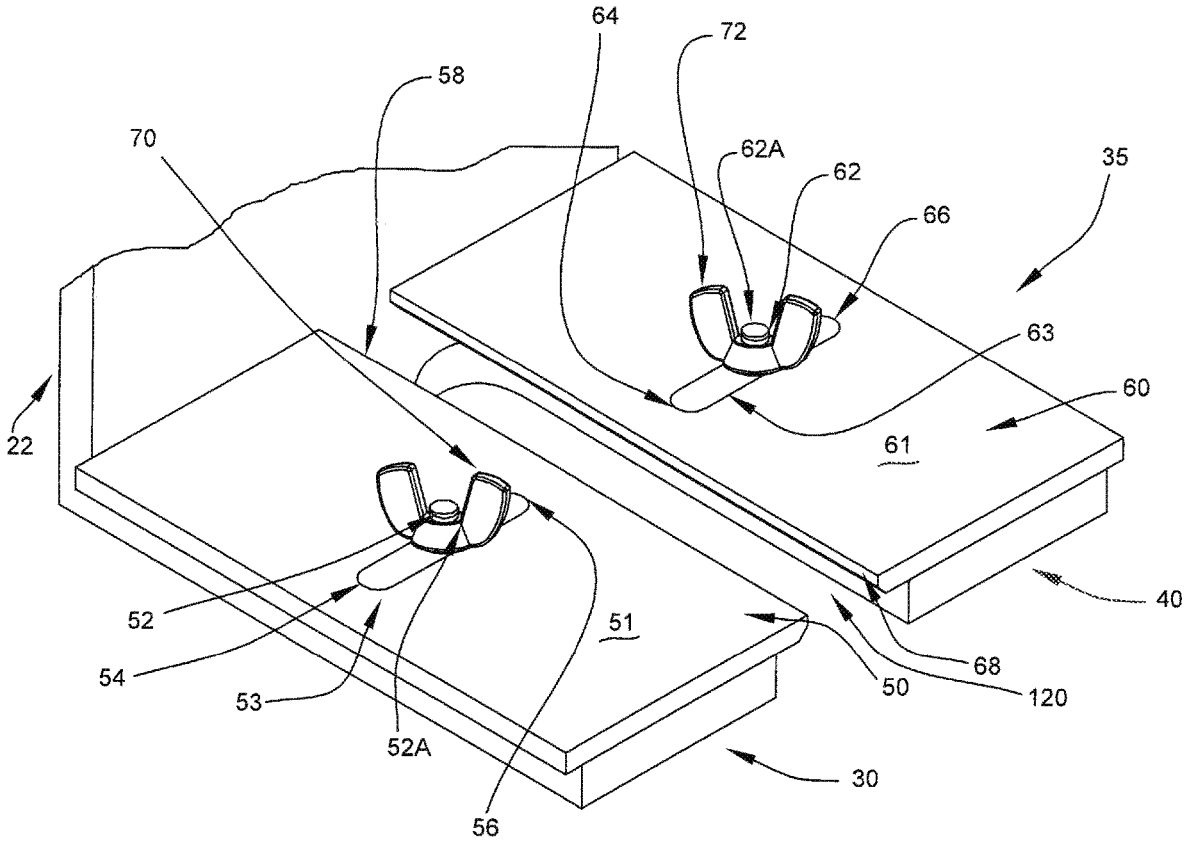
FIG. 4 is a close-up view of the bottom portion of the screw housing member illustrated in FIG. 1, illustrating in detail the gripping plates, two lower wing nuts and corresponding slots, and an apparatus gap between the two gripping plates.

Referring to FIG. 4, there is illustrated a close-up view of the screw housing member bottom portion 35 of screw housing member 10 illustrating a first or left gripping plate 50 that is directly above and moveably affixed to left bottom base plate 30. Left bottom threaded shaft 52 which can also be referred to as a "left bottom threaded stud 52" is firmly and permanently attached to base plate 30. The left gripping plate 50 can slide relative to the left and right of the left threaded stud 52. The left threaded stud 52 extends from a left stud proximal end 52A into the left bottom base plate 30 and the left threaded stud is therefore permanently affixed. Left bottom wing nut 70 is located at proximal end 52A. Left bottom threaded stud 52 and left bottom wing nut 70 are more broadly referred to as left bottom fastener member. Left slot opening 53 has a left slot left edge 54 and a left slot right edge 56 that allows gripping plate 50 to slide from an open position at left slot right edge 56 to a closed position at left slot left edge 54 and grasp a faucet handle 1000 (illustrated in FIG. 3).

Screw housing member bottom portion 35 of screw housing member 10 also has a second or right gripping plate 60 that is directly above and moveably affixed to right bottom base plate 40. Right bottom threaded shaft 62 also referred to as right threaded stud 62 is firmly and permanently attached to base plate 40. The right gripping plate 60 can slide to left and right relative to the fixed threaded stud 62. The right threaded stud 62 extends into base plate 40 where it is permanently affixed. The right bottom wing nut 72 is located at proximal end 62A. The right bottom threaded shaft distal end extends through a right slot opening 63. Right threaded stud 62 and right bottom wing nut 72 are more broadly referred to as right bottom fastening member. Right slot opening 63 has a right slot left edge 64 and a right slot right edge 66 that allow right gripping plate 60 to slide from an open position at right slot left edge 64 to a closed position at right slot right edge 66 to grasp a faucet handle 1000 (illustrated in FIG. 3).

Further referring to FIG. 4, left gripping plate 50 has a right gripping edge 58 and right gripping plate 60 has a left gripping edge 68 that allow a user to open and close left gripping plate 50 and right gripping plate 60 into a position to close apparatus gap 120 and grasp a respective faucet assembly 1500 with the respective gripping edges 58 and 68 within faucet gap G with the right gripping edge 58 and a portion of left gripping plate 50 and left gripping edge 68 and right gripping plate 60 under handle 1000 and by way of example, under collar 1012 and above top surface 1024 of base 1020 of the faucet. Once the gripping plates are positioned as just described, left lower wing nut 70 and right lower wing nut 72 are rotated to lock each respective wing nut to left gripping plate top surface 51 and right gripping plate top surface 61.

Figure 5A:
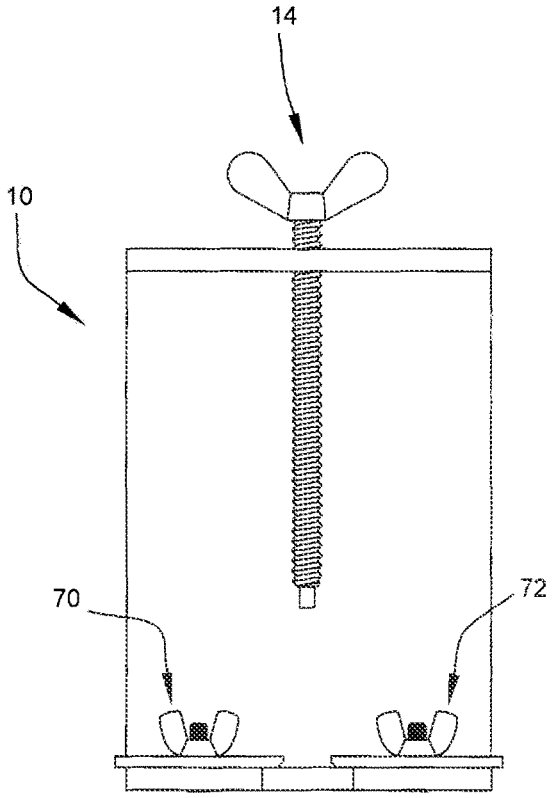
FIG. 5A is a front view of the screw housing member of the present invention.
Figure 5B:
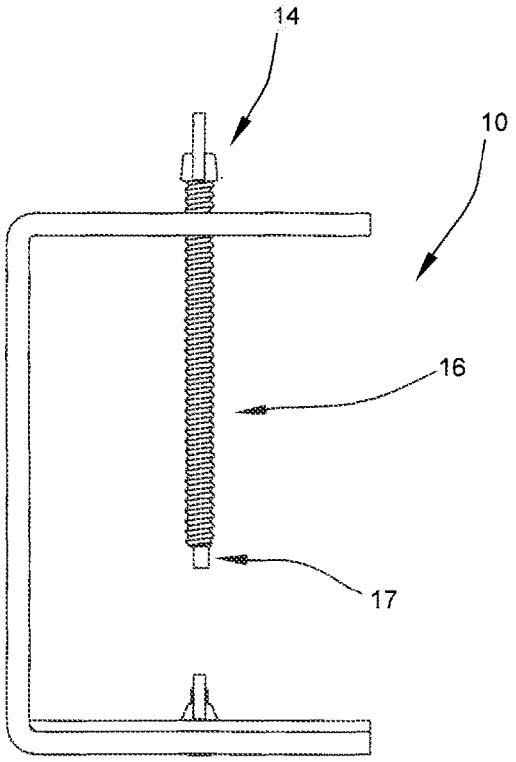
FIG. 5B is a side view of the screw housing member of the present invention.
Figure 6:
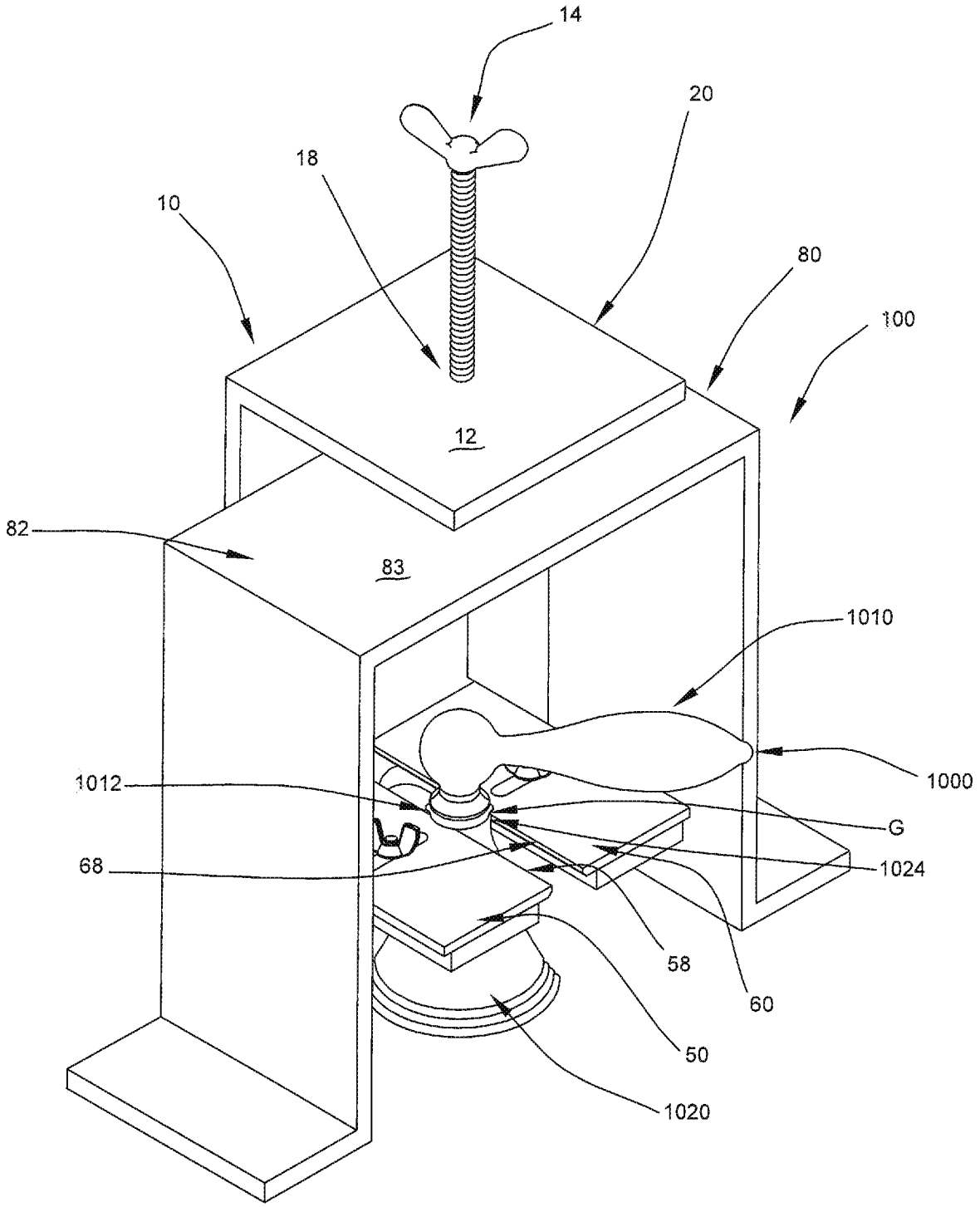
FIG. 6 is a perspective view of the present invention illustrating the screw housing mated to the central housing and the gripping plates surrounding and grasping a collar of the central barrel of a faucet handle prior to removal from the faucet stem, the apparatus gap is between the gripping edges of the two gripping plates and the gripping plates inserted within a faucet between the faucet base top surface and the collar of the central barrel.

Referring to FIG. 5A and FIG. 5B, there is illustrated a front view (FIG. 5A) and a side view (FIG. 5B) of the screw housing member 10 of the present invention faucet handle remover 100 (illustrated in FIG. 6). These views illustrate lower wing nuts 70 and 72 and top wing head 14 causing top threaded shaft 16 to rotate as upper wing head 14 is rotated. Top threaded shaft 16 has a top threaded shaft bottom 17.

Referring to FIG. 6, there is illustrated a perspective view of the present invention faucet handle remover 100 illustrating the screw housing member 10 mated to the central housing member 80 and left gripping plate 50 and right gripping plate 60 positioned to allow left gripping edge 58 and right gripping edge 68 to touch and retain faucet grip 1010 at the location under collar 1012 and over top surface 1024 of faucet base 1020. FIG. 6 illustrates the faucet grip 1010 of faucet handle 1000 prior to it being removed from valve stem 1030 in faucet base 1020.

Figure 7:
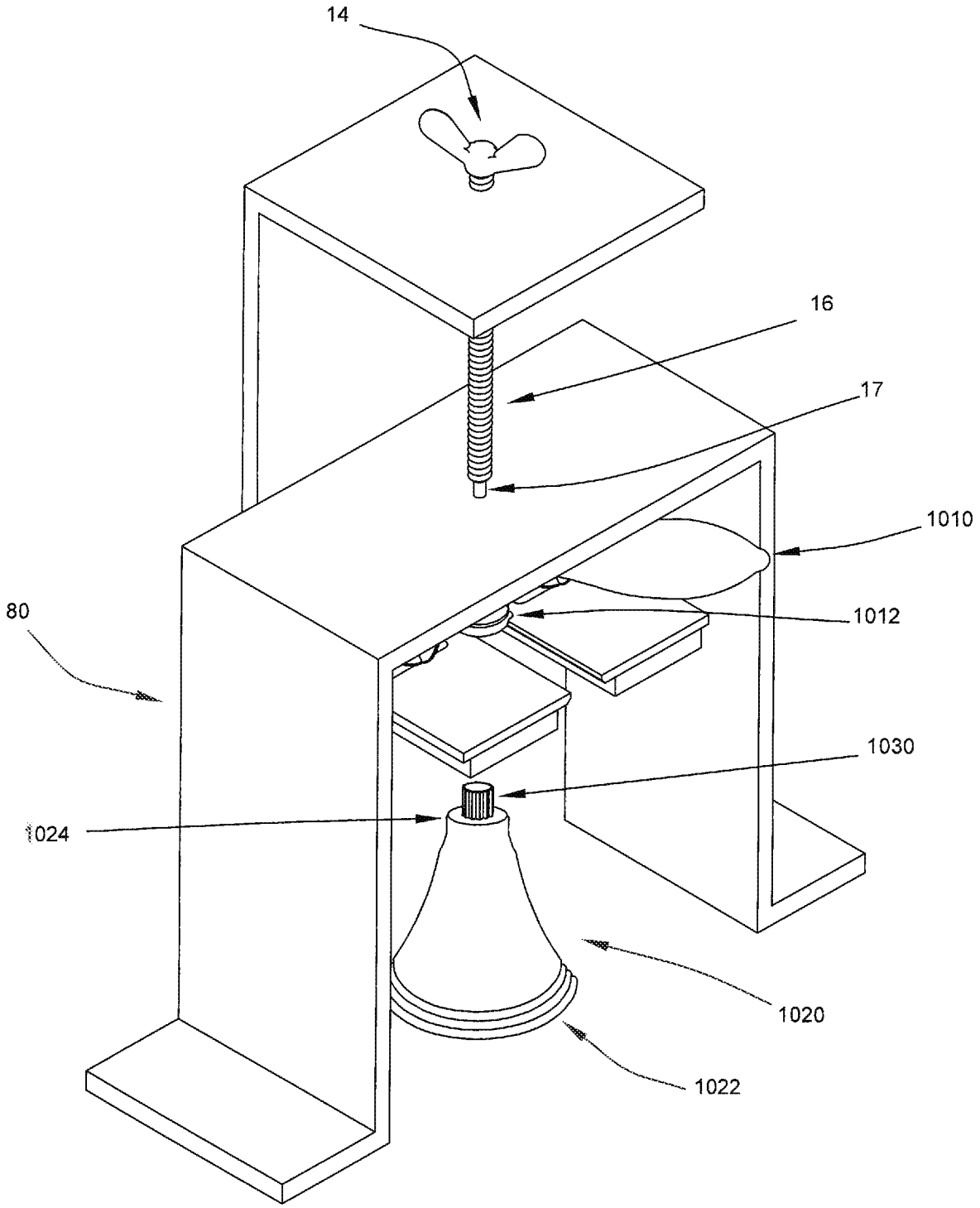
FIG. 7 is a perspective view of the present invention illustrating the screw housing mated to the central housing and the gripping plates gripping the collar of the central barrel of the faucet handle, exposing the corroded valve stem.

Referring to FIG. 6 and FIG. 7, during operation and after left gripping edge 58 and right gripping edge 68 are touching and grasping the collar 1012 of the central barrel 1010C of faucet handle 1000, top wing head 14 is rotated to cause top threaded shaft 16 to pass through top threaded hole 18 located in the center of screw housing top surface 12 of screw housing horizontal wall 20. As top wing head 14 is rotated, screw housing member 10 is forced to move upward by the pressure that top threaded shaft bottom 17 applies to central housing horizontal wall top surface 83 of central housing horizontal wall 82. Therefore, as screw housing member 10 moves upward, faucet grip 1010 of faucet handle 1000 will move upward and break away from faucet valve stem 1030 and grip base 1020. Referring to FIG. 7, there is illustrated screw housing member 10 at a higher elevation than that illustrated in FIG. 6. Therefore, the rotation of top wing head 14 causes screw housing member 10 to rise and force faucet grip 1010 of faucet handle 1000 to be removed from valve stem 1030 and faucet base 1020.

Figure 8:
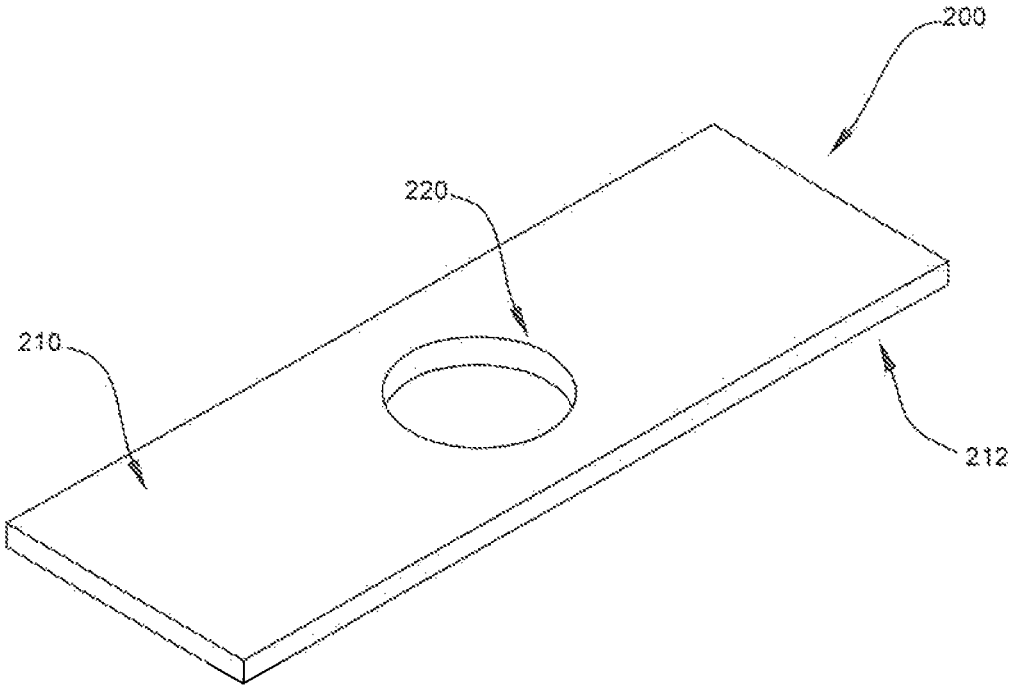
FIG. 8 is a perspective view of an optional surface area plate that fits over a faucet handle assembly and rests on a peripheral surface adjacent the faucet base.
Figure 9:
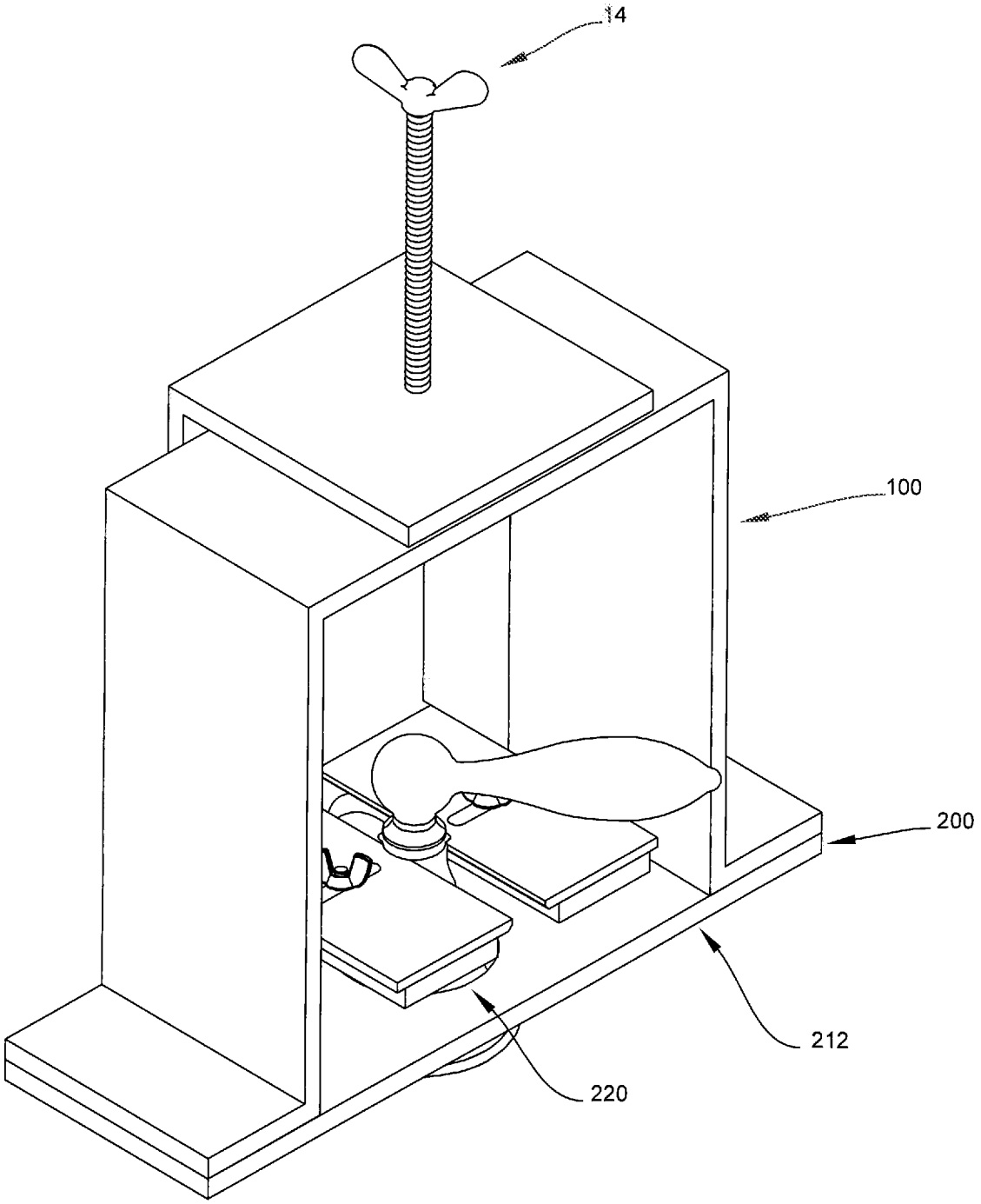
FIG. 9 is perspective view of the present invention adjustable grip dual-mating housing structure for removal of faucet handles with an additional option of a surface area plate that fits over a faucet handle assembly and rests under the horizontal transfer plates of the central housing member to protect fragile sink surfaces in order to avoid applying any force to the sink surface by transferring the load to the valve body instead of the sink surface and thereby eliminating the possibility of damaging the sink.

Referring to FIG. 8 and FIG. 9, there is illustrated a perspective view of a surface area plate 200 having a surface area plate top surface 210 and a surface area plate bottom surface 212 that is used to transfer the downward force that is generated by the rotation of top wing head 14 over the valve body instead of the sink counter surface. Without surface area plate 200 the downward pressure from top threaded shaft bottom 17 is transferred through left central housing vertical wall 84 and right central housing vertical wall 86 to left horizontal transfer plate 94 and right horizontal transfer plate 96. For counter surfaces that are more fragile and can be damaged more easily, surface area plate 200 performs the function of transferring the downward axial force through the center hole 220 directly over the faucet base 1020 and therefore reducing the likelihood of damage to a fragile counter top or counter surface by eliminating a direct force on the counter top.

Referring to FIG. 9, surface area plate 200 has a centrally located surface plate hole 220 that fits over faucet grip 1010 of faucet handle 1000 and is then placed underneath central housing member 80. The force from top threaded shaft bottom 17 applied to central housing member 80 as described in detail above during operation will then be transferred over the peripheral surface of faucet base 1020. This eliminates any force to the sink fragile surface.

It is within the spirit and scope of the present invention as described above to have the wing nuts, wing head and corresponding threaded shafts to be made of similarly constructed or common affixing members such as screws and bolts as opposed to wing nuts and wing head screws. Similarly, the threaded shafts could be female threaded shafts being received by male wing nuts or bolts or male threaded shafts being received by female wing nuts or bolts.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus adapted for removing a faucet handle from a faucet, the faucet including at least a faucet body with a faucet base bottom surface, a faucet base top surface, a valve stem, a handle having a faucet grip and a central barrel affixed to a collar with a faucet gap between the collar and the faucet body top surface, the valve stem within the faucet body and extending into and concealed from view by the collar and the central barrel, the apparatus comprising:

a. a screw housing member including a top wing head connected to a top threaded shaft sized to fit through a top threaded hole located in a center of a top surface of a screw housing top horizontal wall, the threaded shaft having a flat bottom end, a screw housing vertical wall affixed to the screw housing top horizontal wall at one end and at an opposite end affixed to both a left bottom base plate and a spaced apart right bottom base plate;

b. a left gripping plate directly above and moveably affixed to the left bottom base plate, the left gripping plate including a right gripping edge, a left slot opening having a left slot left edge and a left slot right edge that allows left gripping plate to slide from an open position at left slot right edge to a closed position at left slot left edge, a fixed left threaded shaft having a proximal end and extending through the left slot opening and threaded into the left bottom base plate;

c. a right gripping plate directly above and moveably affixed to the right bottom base plate, the right gripping plate including a left gripping edge, a right slot opening having a right slot left edge and a right slot right edge that allows right gripping plate to slide from an open position at the right slot left edge to a closed position at the right slot right edge, a fixed right threaded shaft having a proximal end and extending through the right slot opening and threaded into the right bottom base plate;

d. an apparatus gap between the right gripping edge and the left gripping edge;

e. a central housing member including a central housing horizontal wall affixed at one side to a top end of a left central housing vertical wall and affixed at an opposite side to a top end of a right central housing vertical wall to create an open space within the central housing member, the left central housing vertical wall affixed at a bottom end to a left horizontal transfer plate having a left horizontal transfer plate edge, the right central housing vertical wall affixed at a bottom end to a right horizontal transfer plate having a right horizontal transfer plate edge, the bottom of the threaded shaft removably pressed against the central housing horizontal wall retaining the left base plate, the left gripping plate, right base plate and the right gripping plate within said open space; and f. a surface area plate having a central opening aligned with said apparatus gap between the right gripping edge and the left gripping edge, the surface area plate below the left bottom base plate and the right bottom base plate;

g. wherein, the apparatus is configured such that in operation, the apparatus gap of the surface area plate is inserted within a faucet gap between the faucet base top surface and the collar of the central barrel, the left gripping plate and the right gripping plate are moved to a closed position with the right gripping edge adjacent to the left gripping edge, the top wing head is rotated to cause top threaded shaft to pass through top threaded hole located in the center of screw housing top surface of screw housing horizontal wall, as the top wing head is rotated, the bottom of said threaded shaft applies a downward force on the horizontal surface of the central housing member, the screw housing member is forced to move upward by the pressure that shaft bottom applies to the top surface of the central housing top horizontal wall causing the screw housing member to move upward causing left gripping plate and right gripping to move upward with the collar and central barrel section of the handle forced to move upward so that the collar breaks away from the faucet base top surface thereby exposing the valve stem to facilitate subsequent removal of the valve stem.

2. An apparatus adapted for removing a faucet handle from a faucet, the faucet including at least a faucet body with a faucet base top surface, a valve stem, a handle, a faucet gap between a portion of the handle and the faucet body top surface, the valve stem within the faucet body and extending into and concealed from view by a portion of the handle, the apparatus comprising:

a. a screw housing member including a top wing head connected to a top threaded shaft located in and extending through a center of a top surface of a screw housing top horizontal wall, the threaded shaft ending in a bottom, a screw housing vertical wall affixed to the screw housing top horizontal wall at one end and at an opposite end affixed to both the left bottom base plate separated by an apparatus gap from a spaced apart right bottom base plate;

b. a left gripping plate above the left bottom base plate, the left gripping plate including a right gripping edge, the left gripping plate slidably affixed to the left base plate and slidable to a closed and locked position with the right gripping edge and at least a portion of the left gripping plate within said apparatus gap;

c. a right gripping plate above the right bottom base plate, the right gripping plate including a left gripping edge, the right gripping plate slidably affixed to the right base plate and slidable to a closed and locked position with the left gripping edge and at least a portion of the right gripping plate within said apparatus gap;

d. a central housing member including a top transverse wall aligned under the screw housing to horizontal wall and adjacent the bottom of said threaded shaft, the central housing top transverse wall retained by a central housing structure providing an open space beneath the central housing member top transverse wall and spaced apart lower walls, the bottom of the threaded shaft removably pressed against the central housing member top transverse wall retaining the left base plate, the left gripping plate, right base plate and the right gripping plate within said open space;

e. wherein, the apparatus is configured such that in operation, the apparatus gap of the surface area plate is inserted within a faucet gap between the faucet base top surface and the collar of the central barrel of the handle, the left gripping plate and the right gripping plate are moved to a closed position with the right gripping edge adjacent to the left gripping edge, the top wing head is rotated to cause the bottom of top threaded shaft to apply force on the top horizontal surface of the central housing member, the screw housing member is forced to move upward by the pressure that the bottom of the threaded shaft places to the top surface of the central housing top transverse wall causing the screw housing member to move upward causing left gripping plate and right gripping to move upward with the handle forced to move upward so that the handle breaks away from the faucet base top surface thereby exposing the valve stem to facilitate subsequent removal of the valve stem.

3. The apparatus in accordance with claim 2, further comprising: a surface area plate below the left horizontal transfer plate and the right horizontal; transfer plate of the central housing member.

4. An apparatus adapted for removing a faucet handle from a faucet base top surface, the apparatus comprising:

a. a screw housing member including a top wing head connected to a top threaded shaft extending through a screw housing top horizontal wall, the threaded shaft having a bottom end, a screw housing vertical wall affixed to the screw housing top horizontal wall at one end and at an opposite end affixed to both a left bottom base plate separated by an apparatus gap from a spaced apart right bottom base plate;

b. a left gripping plate above and slidably affixed to the left bottom base plate, the left gripping plate including a right edge, means to enable the left gripping plate to slide to a closed and locked position with the right edge and at least a portion of the left gripping plate in the faucet gap;

c. a right gripping plate above and slidably affixed to the right bottom base plate, the right gripping plate including a left edge, means to enable the right gripping plate to slide to a closed and locked position with the left edge and at least a portion of the right griping plate in the faucet gap; and d. a central housing member including a top transverse wall aligned under the screw housing to horizontal wall and adjacent the bottom of said threaded shaft, the central housing top transverse wall retained by a central housing structure providing an open space beneath the central housing member top transverse wall and spaced apart lower walls, the bottom of the threaded shaft removably pressed against the central housing member top transverse wall retaining the left base plate, the left gripping plate, right base plate and the right gripping plate within said open space;

e. wherein, the apparatus is configured such that in operation, the apparatus gap of the surface area plate is inserted between the faucet base top surface and the collar of the central barrel of the handle, the left gripping plate and the right gripping plate are moved to a closed position with the right edge adjacent to the left edge, the top wing head is rotated to cause the bottom of top threaded shaft to apply a downward force on the top horizontal surface of the central housing member, the screw housing member is forced to move upward by the pressure that threaded shaft bottom applies to the top surface of the central housing top horizontal wall causing the screw housing member to moves upward causing left gripping plate and right gripping to move upward with the handle forced to move upward so that the handle breaks away from the faucet base top surface thereby exposing a valve stem to facilitate subsequent removal of the valve stem.

5. The apparatus in accordance with claim 4, further comprising: a surface area plate below the left horizontal transfer plate and the right horizontal; transfer plate of the central housing member.

* * * * *